United States Patent [19]

Adolfsson

[11] Patent Number: 4,564,126

[45] Date of Patent: Jan. 14, 1986

[54] ARRANGEMENT FOR SUPPLYING GAS TO A LIQUID IN A CONTAINER THEREFOR

[75] Inventor: Bengt O. Adolfsson, Stockholm, Sweden

[73] Assignee: Kommanditbolaget Aldolf, Västerås, Sweden

[21] Appl. No.: 463,445

[22] PCT Filed: May 19, 1982

[86] PCT No.: PCT/SE82/00184

§ 371 Date: Jan. 24, 1983

§ 102(e) Date: Jan. 24, 1983

[87] PCT Pub. No.: WO82/04244

PCT Pub. Date: Dec. 9, 1982

[30] Foreign Application Priority Data

May 25, 1981 [SE] Sweden ..... 8103281

[51] Int. Cl.[4] ..... B67D 5/54

[52] U.S. Cl. ..... 222/61; 222/397

[58] Field of Search ..... 222/399, 55, 57, 58, 222/397, 3, 396, 61, 62, 66, 69; 137/448

[56] References Cited

U.S. PATENT DOCUMENTS 3,128,912 4/1964 Cash ..... 222/61

4,407,340 10/1983 Jensen et al. ..... 222/69 X

*Primary Examiner*—Stanley H. Tollberg

*Attorney, Agent, or Firm*—Sughrue, Mion, Zinn, Macpeak and Seas

[57] ABSTRACT

An apparatus for supplying gas to a liquid in a container (2) having a gas pipe (6) discharging thereinto, the apparatus being particularly intended for preparing aerated beverages. The container comprises an orifice (8) for introducing liquid into the container, an orifice (19) for emptying liquid therefrom, and a gas-venting orifice (13). From a security point of view the apparatus is provided with structure preventing a gas pressure to be built up in the container (2) unless it is filled with liquid to a given level.

8 Claims, 14 Drawing Figures

ARRANGEMENT FOR SUPPLYING GAS TO A LIQUID IN A CONTAINER THEREFOR

TECHNICAL FIELD

The present invention relates to an arrangement for supplying gas to a liquid in a container having a gas conduit discharging thereinto, particularly for preparing aerated beverages. The container is provided with an orifice through which liquid is introduced into the container; an orifice through which liquid can be emptied from the container; and gas-venting means.

BACKGROUND ART

For the purpose of preparing aerated beverages on a small scale, for example in the home, apparatus are known by means of which carbon dioxide can be supplied to water in a bottle, the water then being flavoured with a flavouring substance. In the preparation of such beverages, it is necessary to first fill a bottle with water up to a given level, and then to hold the bottle firmly gripped in the apparatus while supplying carbon dioxide to the water. The bottle is then removed from the apparatus and the flavouring substances added. The beverage is then ready to be poured into a drinking glass or the like.

In addition to being relatively complicated, since among other things it requires the use of a separate bottle whose form and size are adapted to the apparatus in question, the aforedescribed procedure for preparing aerated beverages is also encumbered with other problems and safety risks. Among other things, it is difficult to obtain an accurate seal when using standard bottles, since these bottles can vary greatly in height. In addition, risks are involved when subjecting return bottles to pressure, since in addition to uneven manufacturing quality the bottles may have been damaged during previous use or transportation. Further, in the case of known apparatus the bottle can be pressurized without having been filled with liquid, which presents a risk of serious injury should the bottle explode. It is also possible with known apparatus to overfill the bottle with liquid, rendering it impossible to supply sufficient carbon dioxide to the liquid. In order to aerate a liquid effectively in a container, it is necessary to provide above the surface of the liquid a space in which the gas can be compressed.

It has also been proposed to introduce carbon dioxide into a liquid enclosed in a container fixed in an apparatus, and to pour the aerated liquid directly from the container into a glass. The use of this container is also relatively complicated, however, and in some respects the arrangement is unsafe. Thus, it is also possible with this arrangement to pressurize the container when it is empty. Also, it has been possible to pour liquid from the container while the container still is under high pressure.

OBJECTS OF THE INVENTION

The main object of the present invention is to provide an apparatus of the kind mentioned in the introduction in which the aforementioned disadvantages are eliminated. Thus, in the apparatus according to the invention it shall not be possible to pressurize the container without said container being filled with liquid to a given level.

According to another object it shall not be possible to overfill the container, but that space in which gas can be compressed shall always be present above the surface of the liquid.

BRIEF SUMMARY OF THE INVENTION

The first mentioned object is achieved in accordance with the invention by providing the apparatus with means preventing a gas pressure to be built up in the container unless it is filled with liquid to a given level.

This can be obtained by providing means preventing gas to be supplied to the container unless it is filled with liquid to said level. According to another embodiment of the invention the apparatus is provided with means permitting gas supplied to the container to escape therefrom unless the container is filled with liquid to the given level. Preferably, the container is provided with an orifice through which gas can escape from the container which orifice is closed by a means controlled by the level of liquid in the container.

According to a preferred embodiment the filling orifice of the container is located in the upper part of the container and provided with a closure means controlled by the level of liquid in the container, said filling orifice being so arranged that a volume of gas is enclosed in the container when the filling orifice is closed by said closure means and wherein the gas-venting means has an orifice in the region of said gas volume.

The closure means associated with the filling opening is suitably arranged to float on the liquid, and preferably has the form of a ball arranged in a pipe which projects downwardly from the filling opening. This arrangement prevents the container from being overfilled and enables the aforementioned volume of gas to be obtained automatically above the surface of the liquid. The filling opening is suitably arranged in the top surface of the container, said top surface being conveniently funnel-shaped to facilitate filling of the container.

It is preferred that the pouring orifice located in the lower part of the container is arranged so as to open only when the pressure in the container falls below a given value. For this reason the pouring orifice is suitably provided with a valve which, when being placed in an active state or unblocked can be automatically opened by a force, preferably a spring force, acting on the valve immediately the pressure in the container falls beneath said given value. This prevents liquid from being unintentionally dispensed from the container when the liquid is under high pressure.

Exemplary embodiments of the invention will now be described with reference to the accompanying drawings.

DESCRIPTION OF PREFERRED EMBODIMENTS OF THE INVENTION

Figure 1:
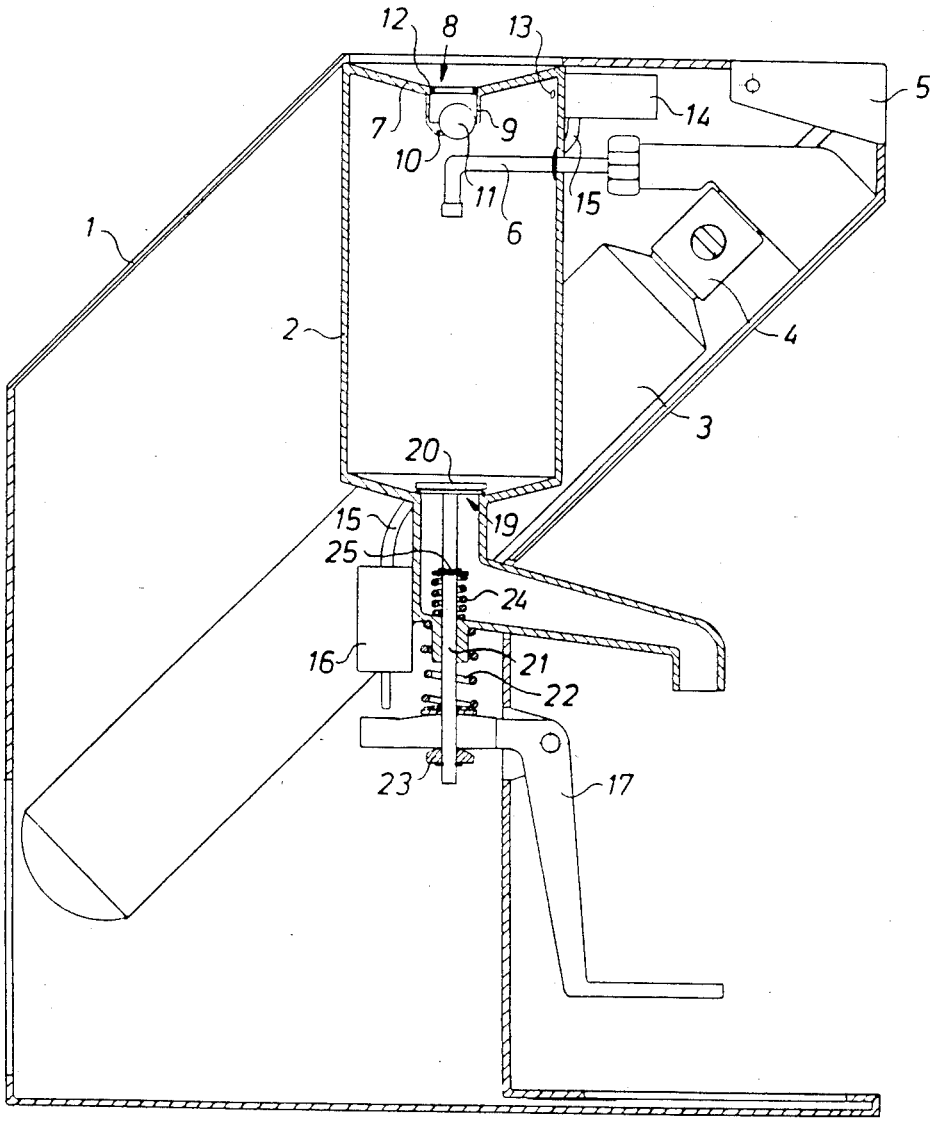
FIG. 1 is an apparatus according to the present invention for preparing aerated beverages in a rest position.
Figure 2:
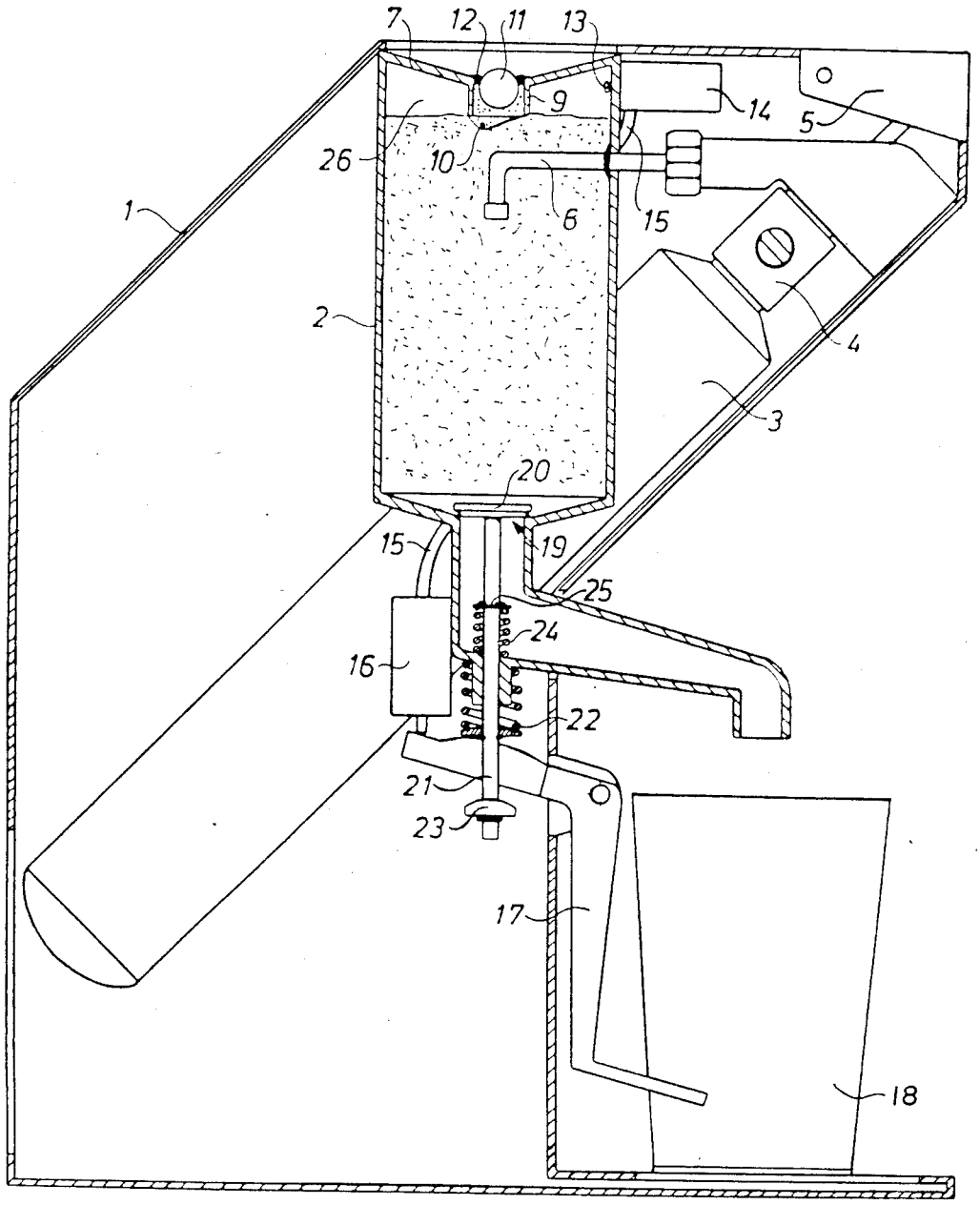
FIG. 2 illustrates the apparatus shown in FIG. 1 during a gas evacuation stage.
Figure 3:
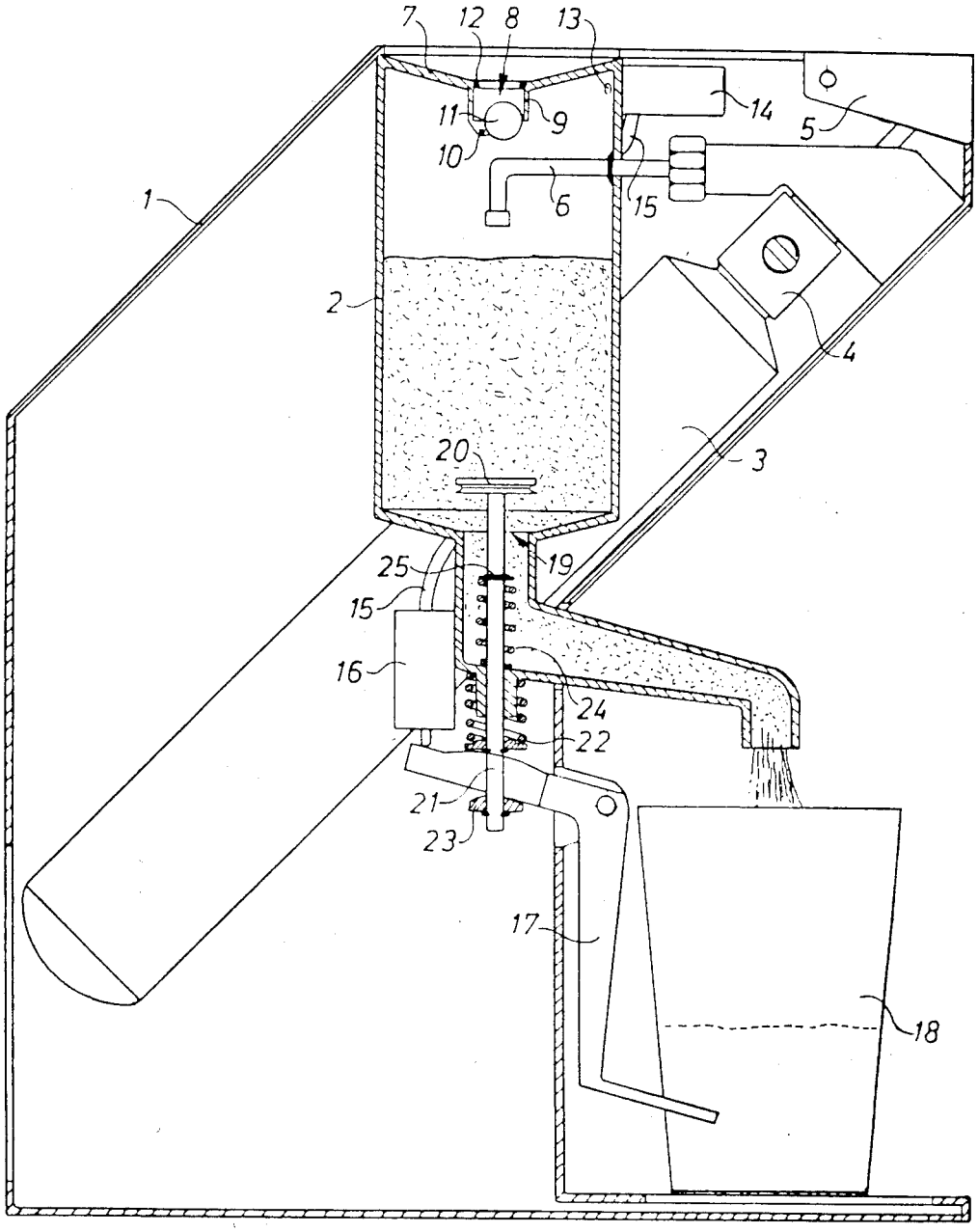
FIG. 3 illustrates the apparatus shown in FIGS. 1 and 2 during a liquid metering stage.

The apparatus illustrated in FIGS. 1-3 comprises a casing 1 which includes a liquid container 2 and a gas bottle or tube 3. The tube 3 is provided with a conventional valve 4, which can be opened by pressing a knob or button 5 for discharging gas through a pipe 6 which opens into the container 2.

The top surface 7 of the container 2 is funnel-shaped and provided with a filling orifice 8 which is surrounded by a downwardly extending pipe 9. Extending across the lower orifice of the pipe 9 is a peg 10 which is eccentrically positioned relative to the centre of the pipe 9 to provide a relatively great passage between a portion of the wall of pipe 9 and a ball 11 held in the pipe by the peg 10. Arranged around the filling orifice 8 is an O-ring 12. The upper part of the container 2 is connected to a gas-venting orifice 13, which communicates with a conventional overload or over-pressure relief valve 14 and with a gas-evacuating valve 16 via a pipe 15, said gas-evacuating valve 16 being actuable by means of a lever 17. The lever 17 is suitably bifurcate and arranged to be pressed inwardly by means of a drinking glass 18.

The bottom of the container 2 is provided with a pouring or tapping orifice 19, which can be closed by means of a valve 20. Around the spindle 21 of the valve 20 is arranged firstly a relatively strong compression spring 22, arranged to bias the valve 20 towards its closed position via the lever 17 and a fixed stop 23 on the spindle 21, and secondly a weaker compression spring 24, arranged to work against a fixed abutment 25 on the spindle 21 in order to open the valve 20.

FIG. 1 illustrates the apparatus in its rest position, i.e. there is no liquid in the container 2 to which gas shall be supplied. In this state of the apparatus, the container cannot be placed under pressure, since any gas supplied to the container is able to pass the ball 11, which occupies its lower limit position in the pipe 9, and out through the filling orifice 8. This prevents the container 2 from being subjected to pressures liable to cause the container to explode, when said container contains a large quantity of gas.

When using the illustrated apparatus, the container 2 is filled with water through the filling orifice 8. Filling of the container is facilitated by the funnel-shape configuration of the top surface 7. The water flows down through the filling orifice 8 and past the ball 11, which occupies its lower position. When the level of water reaches the ball 11, however, the ball, which is arranged to float on the water, will be lifted up and seals against the O-ring 12 around the filling orifice, see FIG. 2. As a result of the presence of pipe 9, a volume of air 26 will be enclosed above the surface of the water in the upper part of the container 2. It is only in this position, in which the ball 11 closes the filling orifice 8, that the pressure in the container 2 can be increased by actuating the knob 5 which permits carbon dioxide to be supplied from the tube 3 to the water in the container, through the pipe 6. When introducing carbon dioxide into the water, the knob 5 is depressed a number of times, until the over-pressure relief valve 14 opens. Opening of the valve takes place when the pressure of the gas in said gas space 26 reaches a pre-set value, and is indicated by means of a distinct sound from the valve 14. Valves of this kind are used in all available types of such apparatus and will not be described in detail.

Creating the gas space or volume 26, in which part of the gas supplied can be compressed, enables a sufficient quantity of gas to be supplied to the liquid. Alternatively, if the liquid is supplied so as to completely fill the container, no appreciable quantity of gas can be supplied to said liquid, since the pressure therein would rise momentarily to a value at which the overload valve 14 opens.

When wishing to dispense the aerated water into a glass 18, the glass is pressed against the lever 17, which compresses the strong spring 22 and opens the evacuation valve 16. When the strong spring 22 is compressed, the second spring 24 endeavours to open the valve 20. The spring 24, however, is dimensioned so that it is unable to open the valve 20 until the pressure in the container 2 has fallen below a predetermined specific level. This prevents liquid from being pressed out of the container under high pressure, which would otherwise cause the liquid to splash out of the glass. Since the lever 17 also opens the evacuation valve 16, however, the pressure in the container 2 will fall rapidly to the pre-selected value, at which the spring 24 is able to open the valve 20. Hence, the water will only be fed from the container 2 by the action of gravity, and provided that the lever 17 is held depressed, thereby enabling the glass 18 to be readily filled to the desired level, as illustrated in FIG. 3. Any flavouring required is then added directly to the glass, optionally whilst stirring. This eliminates the need of cleaning an additional article, such as the container 2, since it only comes into contact with water and gas.

As will be evident from the aforegoing, the apparatus is very simple to use, since all risks due to error are eliminated. Thus, the container cannot be overfilled, since the water can only be filled to a selected level, because the ball 11 automatically closes the opening 8 when this level has been reached. Further, the container cannot be placed under pressure before it has been filled to said given level. Finally, liquid cannot be taken from the container before the pressure therein is such as to enable liquid to be dispensed therefrom in a satisfactory manner. Because of the funnel-shaped top surface 7, it is a simple matter to determine when the container has been filled to the intended level, since when this level is reached water will remain above the filling orifice 8 closed by the ball 11.

Figure 4:
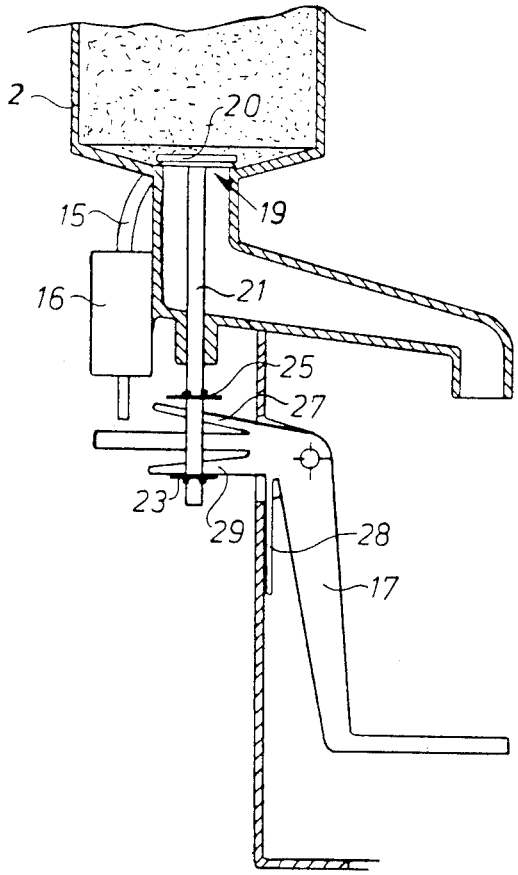
FIG. 4 illustrates an alternative embodiment of the metering means.

FIG. 4 illustrates an alternative embodiment of the lever 17, which in this embodiment comprises a resilient plastics material, such as nylon. In the FIG. 4 embodiment, the springs 22 and 24 of the FIGS. 1-3 embodiment are replaced with two resilient tongues 27 and 28, which together with a further tongue 29 functionally replace the aforementioned springs. The metering means may also be modified in other respects, it being possible, for example, to replace the lever 17 with a knob which when activated opens the evacuating valve 16 and unblocks the valve 20.

Figure 5:
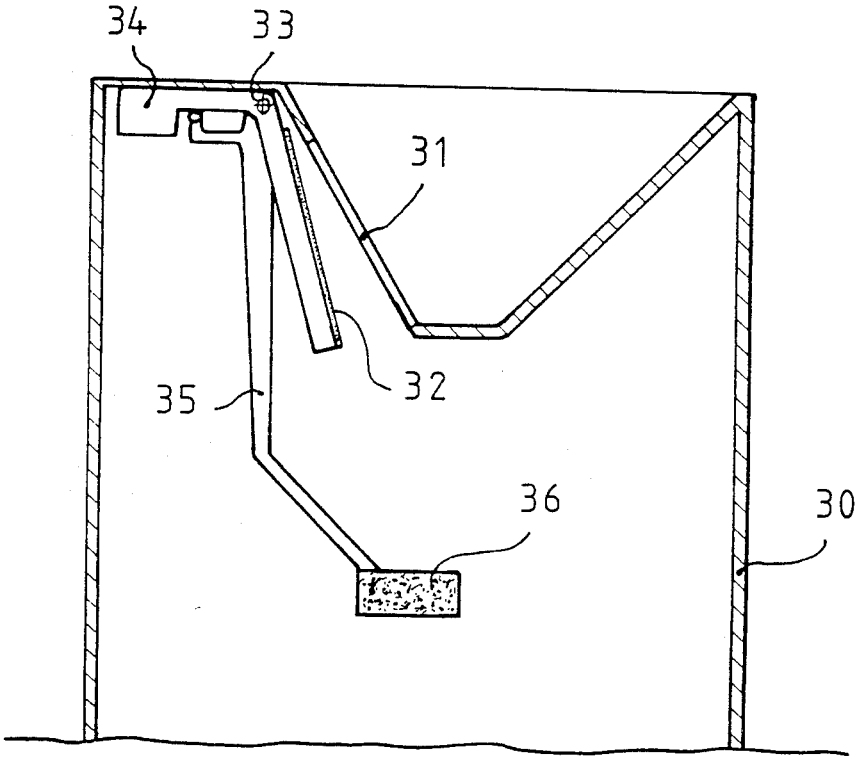
FIGS. 5–8 illustrate the upper portion of a container of another embodiment of the apparatus according to the invention showing the closure member in different stages.

FIG. 5 illustrates the upper portion of an alternative design of a container according to the invention. The means for supplying gas to the container, discharging gas from the container and tapping the aerated liquid from the container has been omitted for clarity. However, these means can be of the same kind as has been described above.

The container 30 is provided with a funnel-shaped top surface provided with an inclined filling orifice 31 arranged to be closed by a closure means 32. The closure means 32 is connected to a pivot pin 33 and can be swung to the closed position under the action of a weight 34. An arm 35 the lower end of which is provided with a float 36 is also connected to the pivot pin 33. In FIG. 5 the weight of the arm 35 and the float 36 locks the closure means 32 in an open position. Thus, in this state the container 30 cannot be pressurized.

Figure 6:
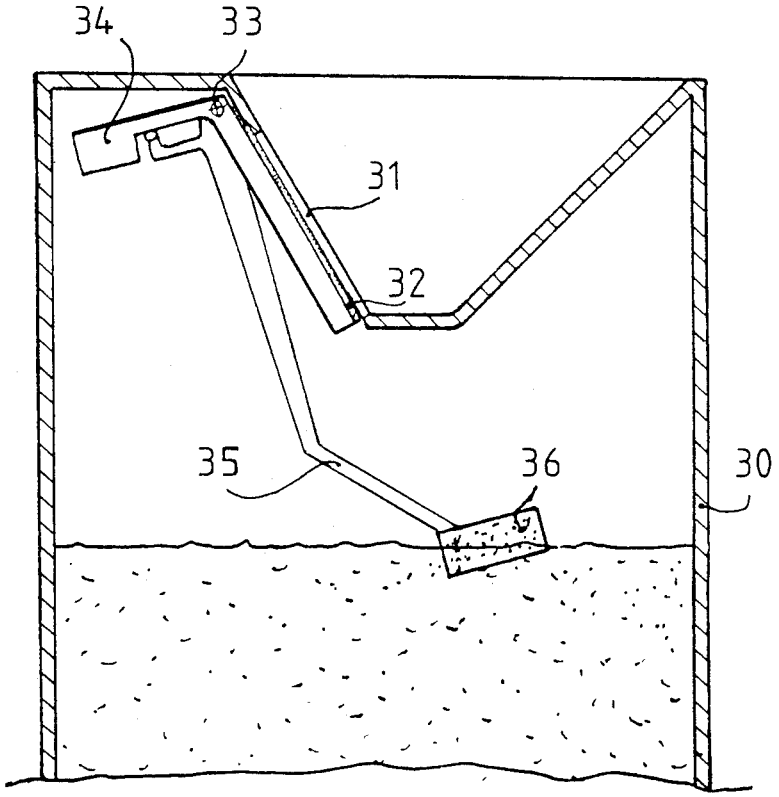
Figure 7:
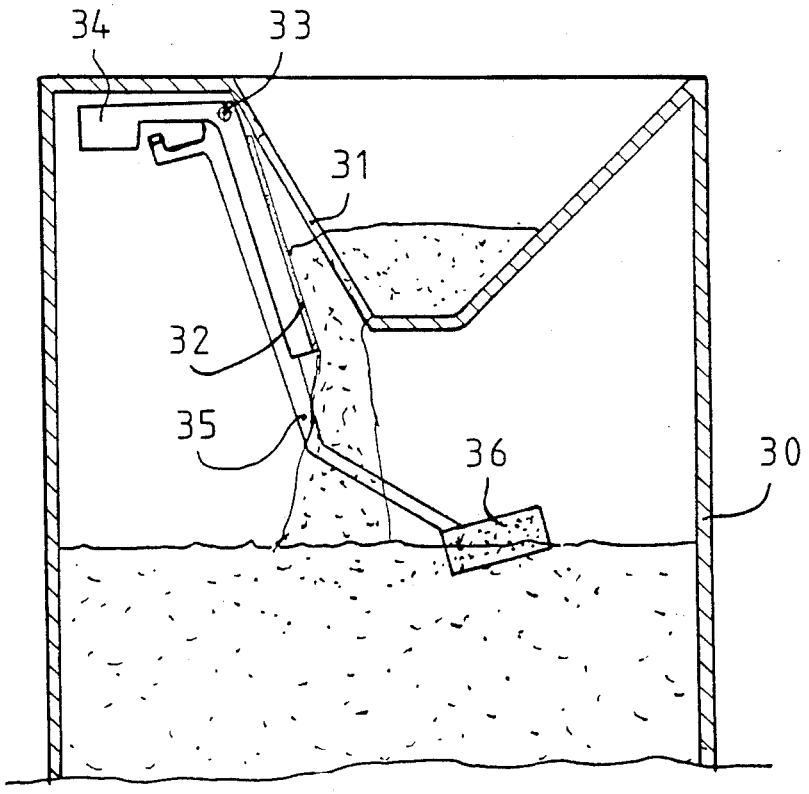
Figure 8:
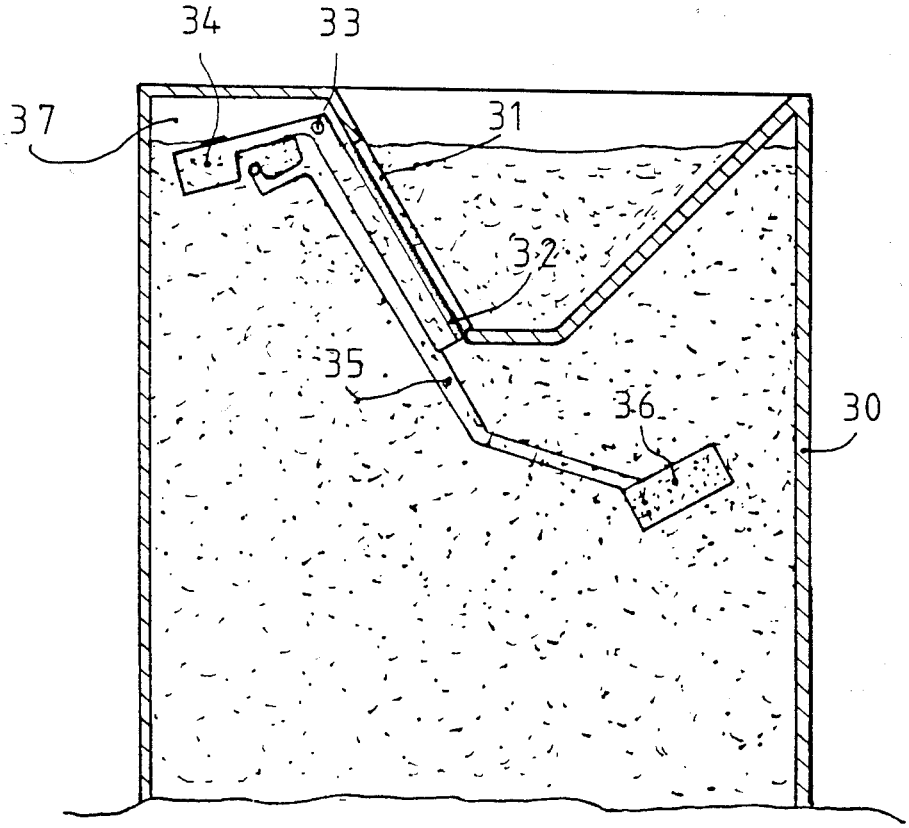

In FIG. 6 the container 30 has been filled with liquid to such an extent that the float 36 is lifted. In this state the closure means 32 is released and is swung to its closed position under the action of the weight 34. The pressure in the container can now be increased as desired. Alternatively, additional liquid can be supplied to the container as illustrated in FIG. 7. In that case the air in the container can pass out of the container above the liquid in the funnel-shaped top surface. Thus, liquid can be supplied to an upper level as illustrated in FIG. 8. Also in this case a gas space or volume is created above the upper limit of the liquid level.

By using a container according to FIGS. 5–8 the container does not have to be completely filled before it can be pressurized but the amount of liquid can be determined by the user. However, a minimum amount of liquid is required from a security point of view before the container can be pressurized.

Figure 9:
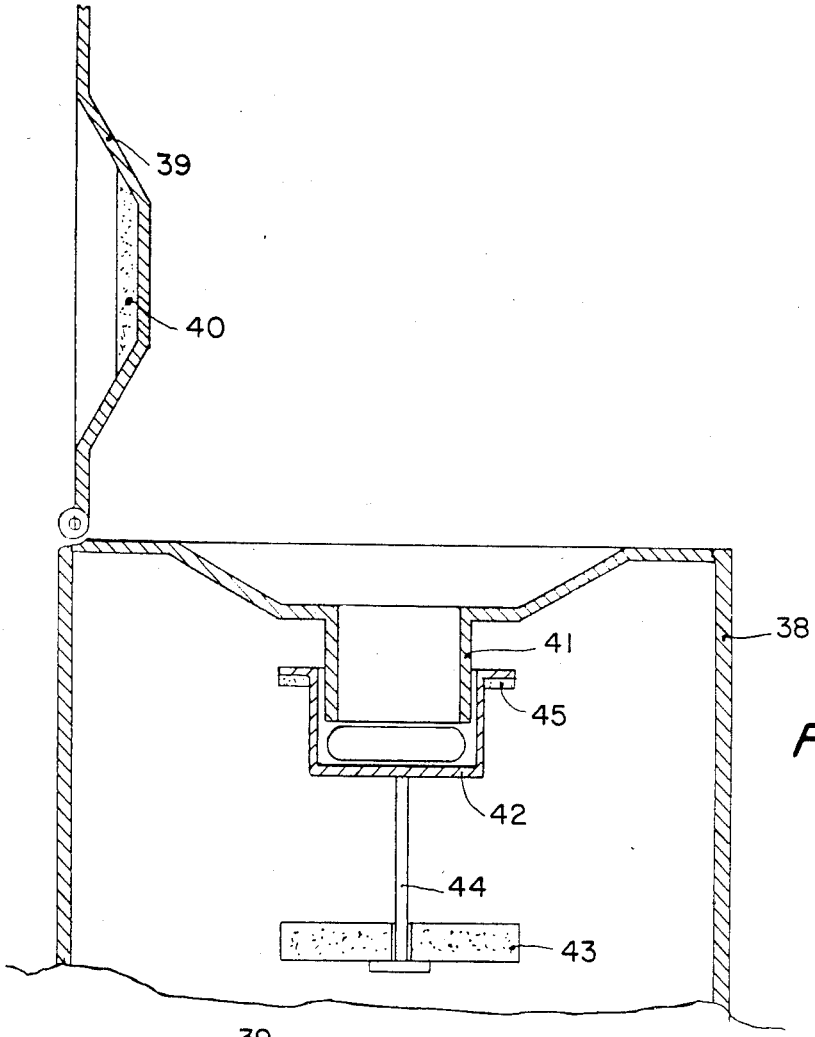
FIGS. 9 and 10 illustrate a further embodiment of the upper portion of a container for an apparatus for preparing aerated beverages in open and closed position, respectively.

FIG. 9 illustrates a further embodiment of the upper portion of a container 38. Connected to the container 38 is a hinged cover 39 provided with a permanent magnet 40. A closure member 42 designed with an extension surrounding the filling pipe 41 is arranged to slide along the pipe 41. In FIG. 9 the closure member 42 is held in its lower open position by means of the weight of a float 43 slidably mounted on a shaft 44 connected to the closure member 42. The closure member 42 is also provided with an annular permanent magnet 45 which is arranged to be attracted by the magnet 40 when the cover 39 is closed. However, the attraction force between the magnets 40 and 45 is too weak to lift the closure member 42 when it carries the float 43 as illustrated in FIG. 9.

Figure 10:
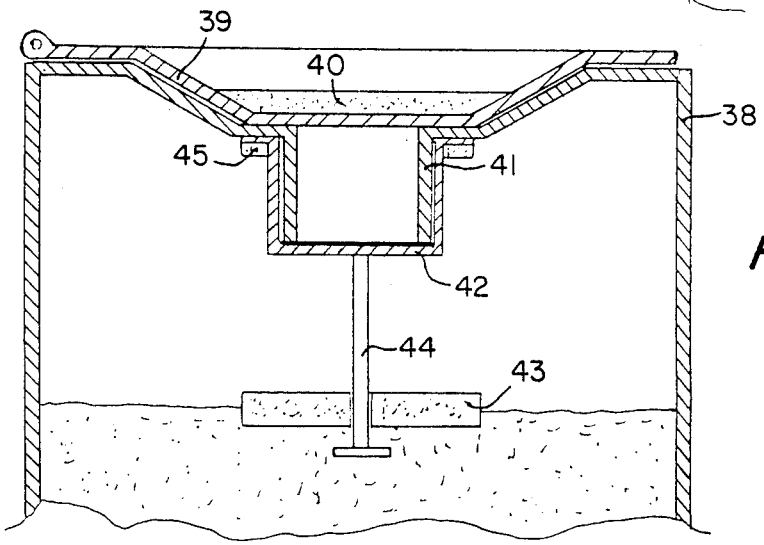

In FIG. 10 the container 38 is filled with liquid to such an extent that the float 43 is lifted. In this state when the cover 39 is closed the attraction force between the magnets 40 and 45 is sufficient to lift the closure member 42 to its close position as illustrated in FIG. 10. Then, the container can be pressurized. Alternatively, additional water can be supplied by opening the cover 39 as the closure member 42 then will fall down. Thus, also this container can be pressurized when filled with liquid between a minimum and a maximum level.

Figure 11:
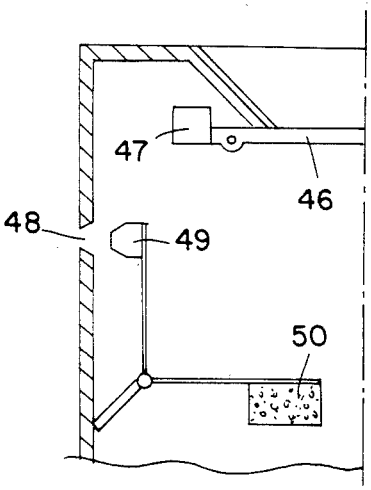
FIGS. 11 and 12 illustrate the upper portion of a container provided with a separate gas outlet in open and closed position, respectively.
Figure 12:
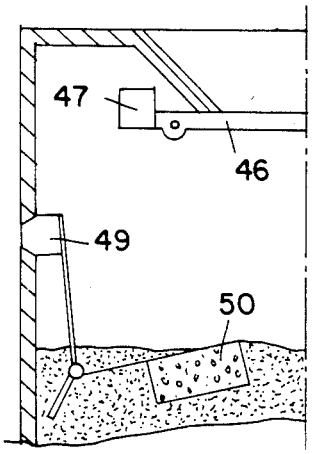

In FIGS. 11 and 12 a further embodiment of a container is illustrated. The filling orifice is provided with a simple flap valve 46 which in its normal position is held closed under the action of a weight 47. However, the valve will be opened when water is supplied to the filling orifice.

In order to prevent the container from being pressurized when no liquid is present the container is provided with a gas outlet 48 closable by means of a swingable member 49 controlled by means of a float 50 as illustrated in FIG. 12. Also this embodiment will give the same advantages as the embodiments of FIGS. 5–10.

Figure 13:
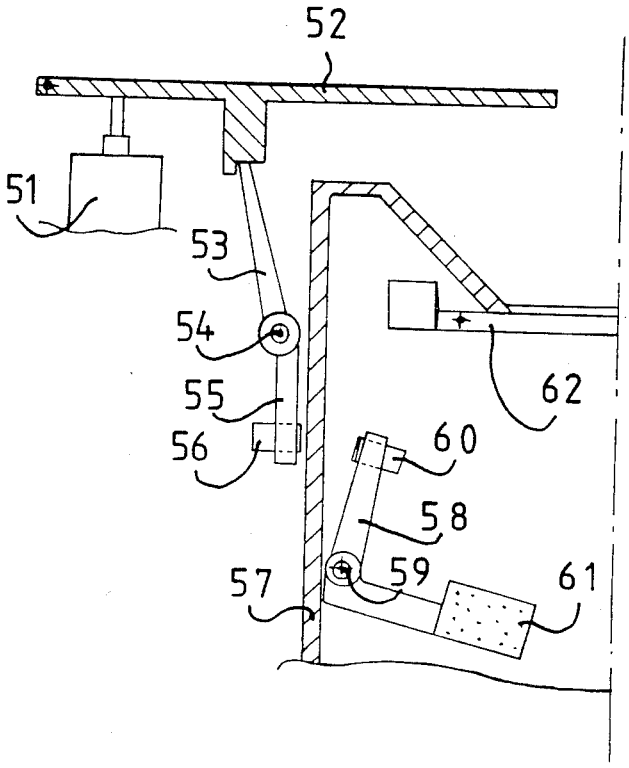
FIGS. 13 and 14 illustrate the upper portion of a container and an associated gas tube of a further embodiment of an apparatus according to the invention showing the gas tube in locked and unlocked position, respectively.
Figure 14:
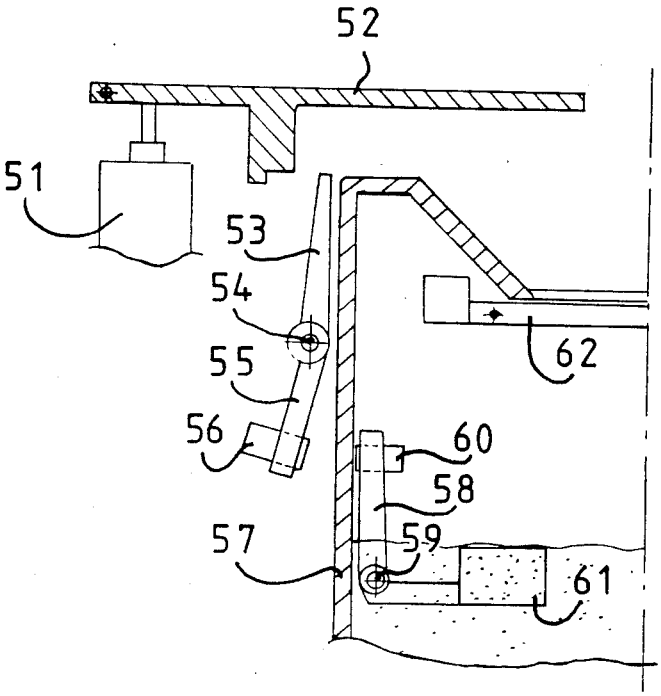

In FIGS. 13 and 14 there are shown an embodiment of an apparatus according to the invention in which pressurized gas cannot be supplied to the container 57 unless this is filled to a given level with a liquid. Reference numeral 51 designates a gas tube which can be opened by means of a lever 52. However, in FIG. 13 the lever 52 cannot be depressed as it is locked by means of a locking arm 53. Thus, in that state gas cannot be supplied to the container 57.

The locking arm 53 is connected to a pivot pin 54 to which also an arm 55 provided with a permanent magnet 56 is connected. Inside the container 57 a knee-lever 58 is arranged swingable around a pivot pin 59. One leg of the knee-lever 58 is provided with a permanent magnet 60 repelling the magnet 56, and the other leg of the knee-lever 58 is provided with a float 61.

In FIG. 14 the container 57 is filled with liquid to such an extent that the float 61 is lifted meaning that the magnet 60 is moved towards the wall of the container which is made of a plastics material. The repelling force between the magnets 56 and 60 results in a swinging movement of the arms 53 and 55 about the pivot pin 54. This means that the locking arm 53 releases the lever 52 which can now be depressed to supply gas to the container 57. The gas pipe is not shown but can be arranged as illustrated in FIGS. 1–4. Also this container can be provided with a simple flap valve 62.

As is realized by the man skilled in the art the means for a liquid level controlled locking and unlocking of the lever 52 or similar means can be designed in many ways. The essential criterion is that it shall not be possible to supply gas to the container unless a minimum amount of liquid is present in the container.

The floats of the above described further embodiments can in many cases be replaced by bodies which do not float on the liquid as in any case the weight of the corresponding bodies will be decreased when submerged into the liquid.

The spring force used to open the tapping orifice can be replaced by for instance a magnetic force.

We claim:

1. An apparatus for domestic use for carbonating water for the subsequent preparation of carbonated beverages by flavouring the carbonated water and including a container (2; 30; 45) having a gas pipe (6) discharging thereinto, said container being provided with a fill orifice (8; 31) through which water is introduced into the container, an orifice (19) for emptying water from the container, and gas-venting means (13, 15, 16), characterized by: means (8; 31; 48) for permitting gas supplied to the container to escape therefrom unless the container is filled with water to a given level, the fill orifice being closeable, a discharge outlet of the gas pipe being disposed below said given level, a small volume of gas always being enclosed in the container above the water surface, and the gas-venting means having an inlet orifice disposed in communication with said gas volume.

2. An apparatus for supplying gas to a liquid in a container (2; 30) having a gas pipe (6) discharging thereinto, said container being provided with a fill orifice (8; 31) through which liquid is introduced into the container, an orifice (19) for emptying liquid from the container, and gas-venting means (13, 15, 16), characterized by: means for permitting gas supplied to the container to escape therefrom unless the container is filled with liquid to a given level, said permitting means compressing both the fill orifice located in an upper part of the container, and a closure means (11; 32) cooperable with the fill orifice and controlled by the level of liquid in the container, said fill orifice being so disposed that a volume of gas (26; 37) is enclosed in the container when the fill orifice is closed by said closure means, and the gas-venting means having an orifice (13) in the region of said gas volume.

3. An apparatus according to claim 2, wherein the closure means is disposed to float on the liquid or be controlled by a member (36) arranged to float on the liquid.

4. An apparatus according to claim 3, wherein the closure means comprises a ball (11) located in a pipe (9) projecting downwardly from the fill orifice (8).

5. An apparatus for supplying gas to a liquid in a container (2; 30; 38; 45; 57) having a gas pipe (6) discharging thereinto, said container being provided with a fill orifice (8; 31) through which liquid is introduced into the container, an orifice (19) for emptying liquid from the container, valve means (20) for normally closing the emptying orifice, and gas-venting means (13, 15, 16), characterized by: means for preventing gas pressure from building up in the container unless it is filled with liquid to a given level, the emptying orifice being located in a lower part of the container, and means for enabling the opening of the emptying orifice valve means only when the pressure in the container is beneath a given value.

6. An apparatus according to claim 5, wherein the emptying orifice is provided with a valve (20), and means for automatically opening the valve when the pressure in the container falls beneath said given value.

7. An apparatus for supplying gas to a liquid in a container (2; 30) having a gas pipe (6) discharging thereinto, said container being provided with a fill orifice (8; 31) through which liquid is introduced into the container, an orifice (19) for emptying liquid from the container, and gas-venting means (13, 15, 16), characterized by: means for preventing gas pressure from building up in the container unless it is filled with liquid to a given level, the fill orifice being disposed in a top surface of the container, and said top surface having a funnel-shaped configuration.

8. An apparatus for supplying gas to a liquid in a container (57) having a gas pipe (6) discharging thereinto, said container being provided with an orifice (8; 31) through which liquid is introduced into the container, an orifice (19) for emptying liquid from the container, and gas-venting means (13, 15, 16), characterized by: means (51, 52) for supplying pressurized gas to the container, movable means (53) for mechanically enabling and disabling said gas supplying means, and float means (58–61) disposed within the container for actuating the movable means to an enabling position in response to the liquid within the container reaching a predetermined minimum level, whereby pressurized gas is prevented from being supplied to and built up in the container unless it is filled with liquid to said minimum level.

* * * * *